US010498097B2

(12) United States Patent
Komoto

(10) Patent No.: US 10,498,097 B2
(45) Date of Patent: Dec. 3, 2019

(54) ELECTRICAL CONNECTOR FOR CONNECTION TO A WEARABLE DEVICE

(71) Applicant: Japan Aviation Electronics Industry, Limited, Tokyo (JP)

(72) Inventor: Tetsuya Komoto, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/156,647

(22) Filed: Oct. 10, 2018

(65) Prior Publication Data

US 2019/0148901 A1 May 16, 2019

(30) Foreign Application Priority Data

Nov. 10, 2017 (JP) ..... 2017-217292

(51) Int. Cl.

| | |
|---|---|
| ***H01R 33/965*** | (2006.01) |
| ***H01R 13/52*** | (2006.01) |
| ***H01R 13/502*** | (2006.01) |
| ***A41D 1/00*** | (2018.01) |
| ***H01R 13/24*** | (2006.01) |
| ***H01R 13/627*** | (2006.01) |
| ***H01R 33/74*** | (2006.01) |

(Continued)

(52) U.S. Cl.

CPC ..... *H01R 33/965* (2013.01); *A41D 1/002* (2013.01); *A41F 1/00* (2013.01); *A44B 99/00* (2013.01); *H01R 13/2442* (2013.01); *H01R 13/502* (2013.01); *H01R 13/5202* (2013.01); *H01R 13/5219* (2013.01); *H01R 13/627* (2013.01); *H01R 13/6272* (2013.01); *H01R 13/64* (2013.01); *H01R 33/74* (2013.01)

(58) Field of Classification Search

CPC ..... H01R 13/5202; H01R 13/5219; H01R 33/965; H01R 13/64; A41D 1/002

USPC ..... 439/37, 271

See application file for complete search history.

(56) References Cited

U.S. PATENT DOCUMENTS

| | | | | |
|---|---|---|---|---|
| 6,895,261 | B1 * | 5/2005 | Palamides | H04B 1/385 455/100 |
| 10,109,963 | B2 * | 10/2018 | Komoto | A41D 1/002 |
| 2012/0234111 | A1 | 9/2012 | Molyneux et al. | |

FOREIGN PATENT DOCUMENTS

| | | | |
|---|---|---|---|
| EP | 3226362 | A1 | 10/2017 |
| JP | 2015-135723 | A | 7/2015 |
| KR | 101651654 | B1 | 9/2016 |

* cited by examiner

*Primary Examiner* — Abdullah A Riyami
*Assistant Examiner* — Justin M Kratt
(74) *Attorney, Agent, or Firm* — Muncy, Geissler, Olds & Lowe, P.C.

(57) ABSTRACT

A connector includes a garment-side connector portion and a module-side connector portion, the garment-side connector portion has a garment-side connector body with a first fitting surface and a lateral wall, first contacts and a locking portion disposed on the first fitting surface, the module-side connector portion has a module-side connector body with a second fitting surface and a lateral surface, second contacts and a portion to be locked disposed in the second fitting surface, an elastically deformable first waterproof member is disposed on one of the lateral wall of the garment-side connector body and the lateral surface of the module-side connector body so as to surround the first fitting surface or the second fitting surface, and the locking portion locks a position of the portion to be locked only when the module-side connector body is fitted with the garment-side connector body in a predetermined orientation.

16 Claims, 16 Drawing Sheets

(51) Int. Cl.

| | |
|---|---|
| ***A41F 1/00*** | (2006.01) |
| ***A44B 99/00*** | (2010.01) |
| ***H01R 13/64*** | (2006.01) |

ELECTRICAL CONNECTOR FOR CONNECTION TO A WEARABLE DEVICE

BACKGROUND OF THE INVENTION

The present invention relates to a connector, particularly to a connector used to mount a module of a wearable device on a garment to establish electrical connection therebetween.

In recent years, so-called wearable devices in which terminal devices such as various sensors and communication devices operate as being worn by a user have attracted attention. Such a wearable device is electrically connected to a device like a measuring device or a power source to transmit detected information or receive power supply. While electrical connection can be established via a connector attached to a garment, the connection via the connector has to be disconnected when the wearable device is detached, when the garment is washed, and on other occasions.

To cope with it, for instance, a snap button connector has been used to establish connection between devices, as disclosed in JP 2015-135723 A.

As shown in FIG. 46, the snap button connector disclosed in JP 2015-135723 A includes a male snap button 2 attached to first cloth 1 and a female snap button 4 attached to second cloth 3. The first cloth 1 and the second cloth 3 are made from conductive cloth, while the male snap button 2 and the female snap button 4 are formed of a conductive material. When a convex portion 5 of the male snap button 2 is inserted into a concave portion 6 of the female snap button 4 and pressed with two bar-like springs 7 of the female snap button 4, the male snap button 2 and the female snap button 4 are electrically connected to each other, whereby the first cloth 1 and the second cloth 3 are electrically connected to each other via the male snap button 2 and the female snap button 4.

Electrical connection of a wearable device can be made using the snap button connector as above, and when the wearable device is detached or the garment is washed for example, the electrical connection via the snap button connector can be released by separating the male snap button 2 from the female snap button 4.

Meanwhile, the snap button connector of JP 2015-135723 A does not have waterproof structure even though it is a connector to be attached to a garment in use, and thus water may enter the contacting part between the convex portion 5 of the male snap button 2 and the concave portion 6 of the female snap button 4. Accordingly, there is a problem in that, even if the connector is only slightly exposed to water in a living environment, an attached water drop may cause a short-circuit at the contacting part and hinder the normal operation of the connected wearable device.

In addition, if an attempt is made to provide waterproof structure to a connector that is used to mount a module of a wearable device on a garment to establish electrical connection therebetween by fitting a module-side connector portion into a garment-side connector portion, a waterproof member such as an O-ring needs to be installed on a lateral surface of the main body of the module-side connector portion to make a region between the module-side connector portion and the garment-side connector portion watertight, and in order to increase a waterproof effect, it is preferable for the main body of the module-side connector portion to have a smooth and symmetric outline.

When, however, the main body of the module-side connector portion is formed to have a smooth and symmetric outline, this allows the module-side connector portion to be fitted to the garment-side connector portion even in a wrong orientation different from the correct orientation, and thus fitting errors may easily occur.

SUMMARY OF THE INVENTION

The present invention has been made to overcome such conventional problems and provide a connector that can prevent a module-side connector portion from being fitted in a garment-side connector portion in the wrong orientation, while achieving an excellent waterproof effect.

A connector according to the present invention is one for mounting a module of a wearable device on a garment to establish electrical connection therebetween, and comprises:

a garment-side connector portion to be attached to the garment; and a module-side connector portion to be fitted to the garment-side connector portion, wherein the garment-side connector portion includes a garment-side connector body having a first fitting surface and a lateral wall surrounding the first fitting surface, one or more first contacts disposed on the first fitting surface of the garment-side connector body, and a locking portion disposed on the first fitting surface of the garment-side connector body, wherein the module-side connector portion includes a module-side connector body having a second fitting surface that, when the module-side connector portion is fitted with the garment-side connector portion, faces the first fitting surface and also having a lateral surface surrounding the second fitting surface, one or more second contacts disposed in the second fitting surface of the module-side connector body, and a portion to be locked disposed on the second fitting surface of the module-side connector body, wherein a first waterproof member that is elastically deformable is disposed on one of the lateral wall of the garment-side connector body and the lateral surface of the module-side connector body so as to surround the first fitting surface or the second fitting surface, wherein the locking portion locks a position of the portion to be locked only when the module-side connector body is fitted with the garment-side connector body in a predetermined orientation, and wherein the one or more first contacts and the one or more second contacts are electrically connected to each other, the module-side connector portion is fitted with the garment-side connector portion, and the first waterproof member is elastically compressed between the lateral wall of the garment-side connector body and the lateral surface of the module-side connector body, whereby water is prevented from entering the first fitting surface and the second fitting surface.

DETAILED DESCRIPTION OF THE INVENTION

An embodiment of the present invention is described below based on the appended drawings.

Figure 1:
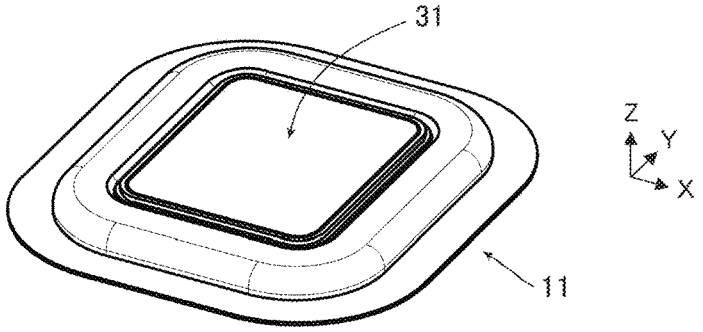
FIG. 1 is a perspective view showing a connector according to an Embodiment in a fitted state.
Figure 2:
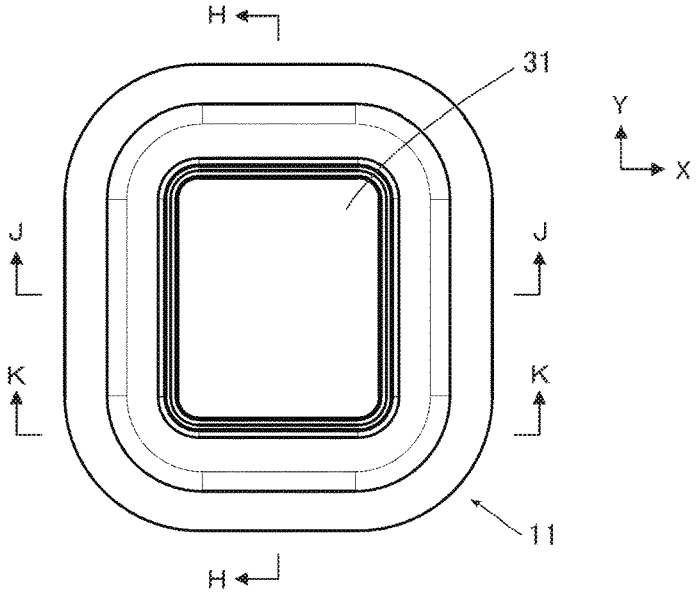
FIG. 2 is a plan view showing the connector according to the Embodiment in the fitted state.

FIGS. 1 and 2 show the structure of a connector according to Embodiment. The connector includes a garment-side connector portion 11 to be attached to a garment and a module-side connector portion 31 to be fitted with the garment-side connector portion 11.

Figure 3:
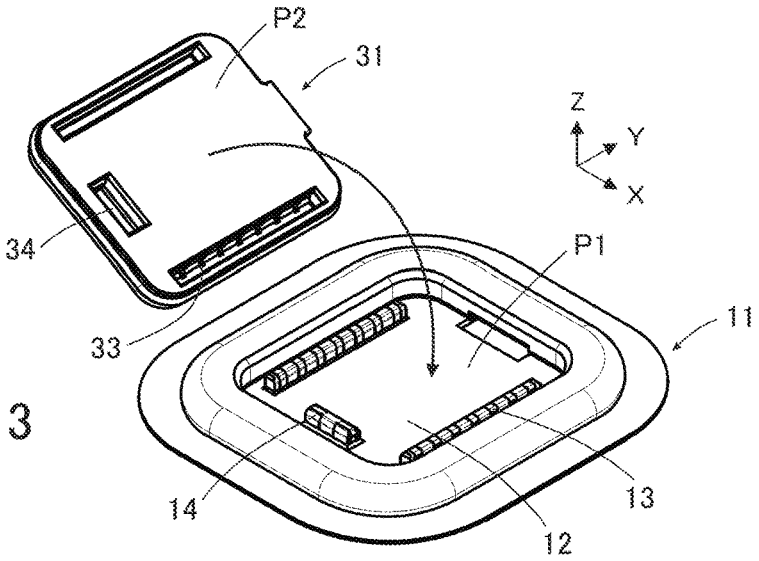
FIG. 3 is a perspective view showing a garment-side connector portion and a module-side connector portion used in the connector of the Embodiment.

As shown in FIG. 3, the garment-side connector portion 11 has a module-side connector accommodating portion 12 of recess shape, and a plurality of first contacts 13 are aligned on a first fitting surface P1, which is the bottom surface of the module-side connector accommodating portion 12, in two rows along two straight lines parallel to each other. A locking portion 14 of convex shape is also disposed on the first fitting surface P1 between the two rows formed of the first contacts 13 and near one ends of the rows.

The module-side connector portion 31 has a second fitting surface P2, and a plurality of second contacts 33 are aligned on the second fitting surface P2 in two rows along two straight lines parallel to each other. A portion to be locked 34 is also formed in the second fitting surface P2 between the two rows formed of the second contacts 33 and near one ends of the rows.

The module-side connector portion 31 is accommodated in the module-side connector accommodating portion 12 such that the second fitting surface P2 comes close to and faces the first fitting surface P1 of the garment-side connector portion 11, and is thereby fitted with the garment-side connector portion 11.

For convenience, in the state where the garment-side connector portion 11 and the module-side connector portion 31 are fitted together, the direction in which the first contacts 13 and the second contacts 33 are aligned in rows is called "Y direction," the direction along the first fitting surface P1 and the second fitting surface P2 and perpendicular to the Y direction is called "X direction," and the direction in which the first fitting surface P1 faces is called "+Z direction."

The locking portion 14 of the garment-side connector portion 11 is provided near the −Y directional end of the first fitting surface P1, while the portion to be locked 34 of the module-side connector portion 31 is provided near the −Y directional end of the second fitting surface P2.

Figure 4:
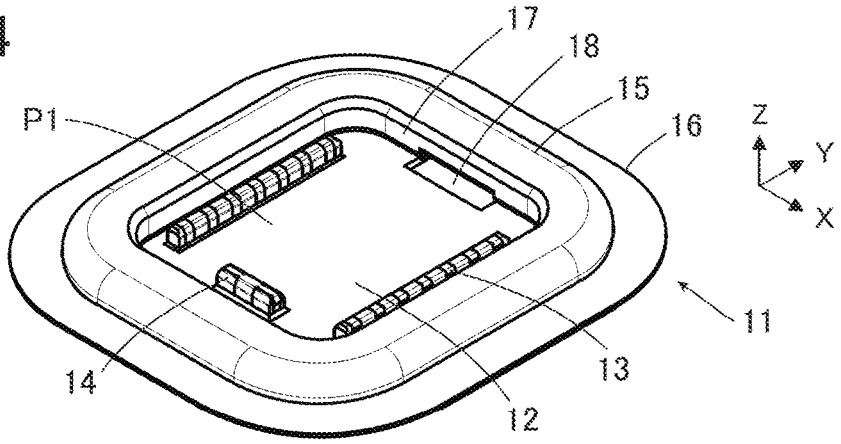
FIG. 4 is a perspective view showing the garment-side connector portion in the connector of the Embodiment.
Figure 5:
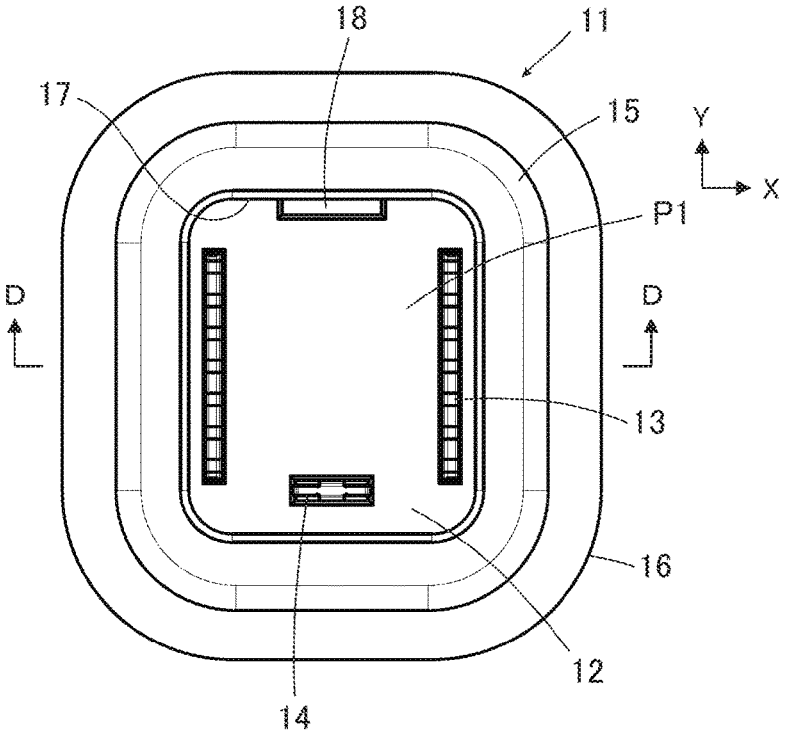
FIG. 5 is a plan view showing the garment-side connector portion in the connector of the Embodiment.

As shown in FIGS. 4 and 5, the garment-side connector portion 11 includes a garment-side connector body 15 in which the module-side connector accommodating portion 12 of recess shape is formed, and the garment-side connector portion 11 is fixed to a garment when the garment-side connector body 15 is attached to a conductive sheet 16.

The module-side connector accommodating portion 12 is formed using a lateral wall 17 rising along the circumference of the first fitting surface P1, and the bottom surface surrounded by the lateral wall 17 forms the first fitting surface P1. A recess portion 18 that is recessed in the −Z direction from the module-side connector accommodating portion 12 is formed at the +Y directional end of the module-side connector accommodating portion 12.

Figure 6:
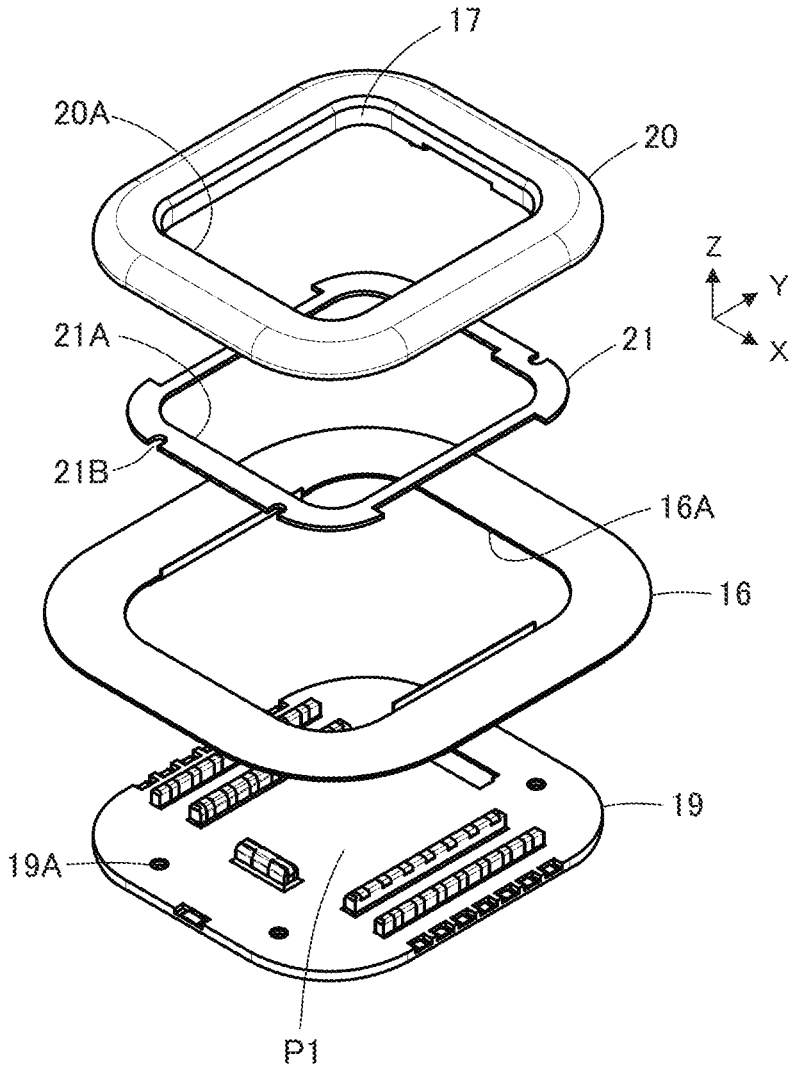
FIG. 6 is an exploded perspective view of the garment-side connector portion in the connector of the Embodiment as viewed from obliquely above.
Figure 7:
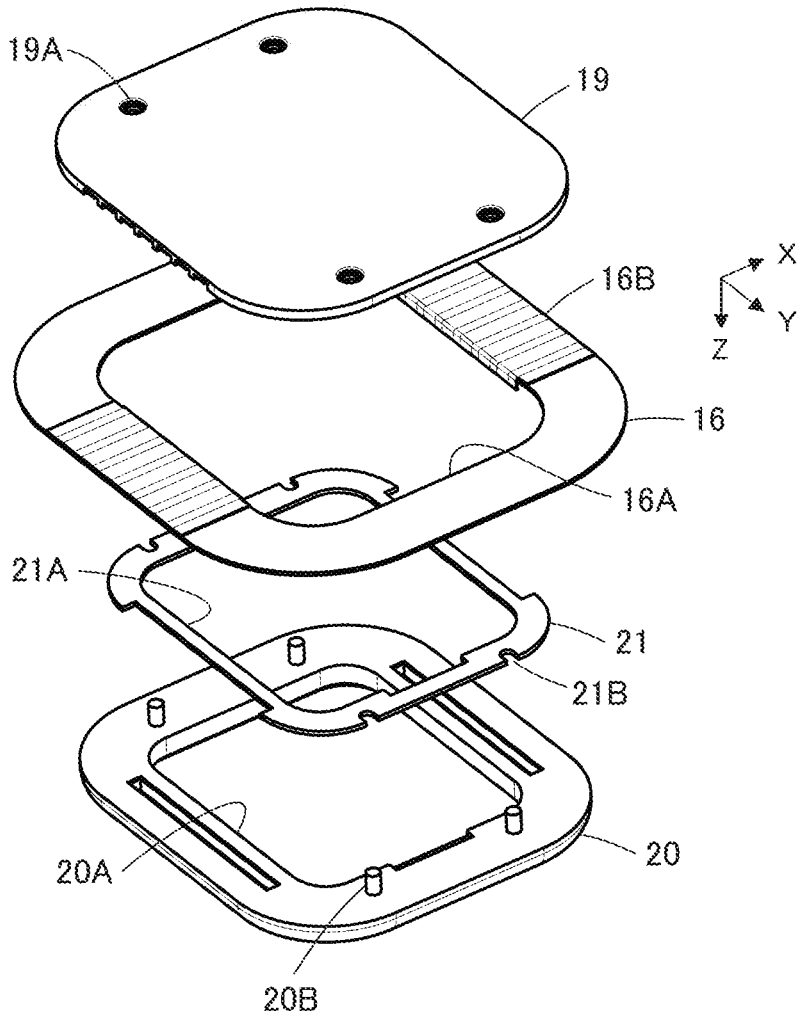
FIG. 7 is an exploded perspective view of the garment-side connector portion in the connector of the Embodiment as viewed from obliquely below.

FIGS. 6 and 7 show exploded perspective views of the garment-side connector portion 11. The garment-side connector portion 11 has the structure in which the conductive sheet 16 and a sheet-type waterproof member (second waterproof member) 21 are sandwiched and held between a first insulating member 19 and a second insulating member 20.

The first insulating member 19 and the second insulating member 20 are joined together to constitute the garment-side connector body 15, and a surface of the first insulating member 19 of flat plate shape forms the first fitting surface P1. The second insulating member 20 of frame shape has an opening 20A provided for exposing the first fitting surface P1, and the lateral wall 17 is formed along the circumference of the opening 20A.

When four bosses 20B formed on the second insulating member 20 are inserted in four insertion holes 19A formed in the first insulating member 19, the first insulating member 19 and the second insulating member 20 are joined to be integral with each other.

The conductive sheet 16 is to be disposed on an unshown garment and includes: an opening 16A that is formed in the central part of the conductive sheet 16 and receives the sheet-type waterproof member 21; and a plurality of conductive members 16B corresponding to the first contacts 13. One end of each conductive member 16B projects to the inside of the opening 16A of the conductive sheet 16.

The sheet-type waterproof member 21 is a frame-shaped member formed to be slightly larger in thickness than the conductive sheet 16 and made of an elastically deformable material such as rubber. An opening 21A for exposing the first fitting surface P1 formed from the surface of the first insulating member 19 is formed of the inside of the frame shape of the sheet-type waterproof member 21. This opening 21A has the substantially same size as that of the opening 20A of the second insulating member 20. The outer periphery of the sheet-type waterproof member 21 is provided with four cutouts 21B corresponding to the four bosses 20B of the second insulating member 20.

Figure 8:
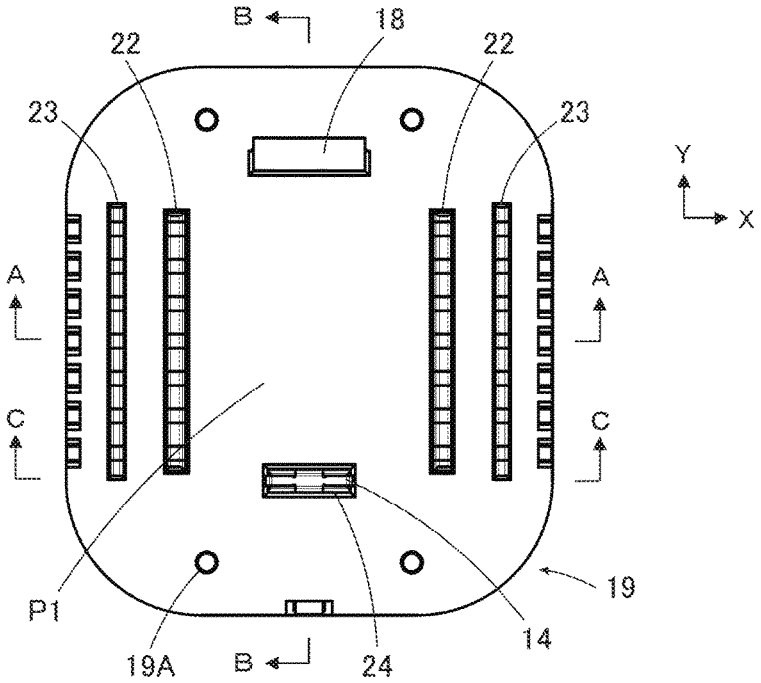
FIG. 8 is a plan view showing a first insulating member of a garment-side connector body in the garment-side connector portion.
Figure 9:
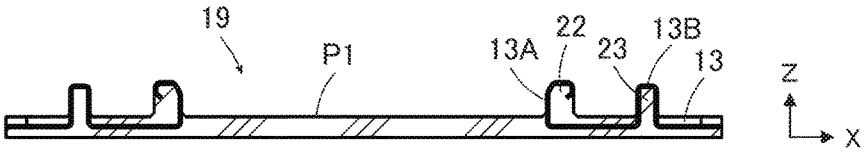
FIG. 9 is a cross-sectional view taken along line A-A in FIG. 8.

As shown in FIGS. 8 and 9, the first insulating member 19 has two convex portions 22 that project from the first fitting surface P1 in the +Z direction, face each other in the X direction and extend in the Y direction. The first insulating member 19 also has two projections 23 that project from the first fitting surface P1 in the +Z direction and extend in the Y direction in parallel to the corresponding convex portions 22 in positions outside the two convex portions 22, that is, positions closer to the lateral edge portions of the first insulating member 19 than the convex portions 22 are.

The recess portion 18 is formed in the vicinity of the Y directional end of the first fitting surface P1 of the first insulating member 19.

As shown in FIG. 9, the first contact 13 is disposed in the first insulating member 19 to be exposed on surfaces of the convex portion 22 and the projection 23 and embedded in the first insulating member 19 in regions other than the convex portion 22 and the projection 23. A part of the first contact 13 that is exposed on the surface of the convex portion 22 forms a second contact contacting portion 13A having no spring properties, while another part of the first contact 13 that is exposed on the surface of the projection 23 forms an outside contacting portion 13B.

In such a manner, the second contact contacting portions 13A of the first contacts 13 are exposed on the surface of each convex portion 22 and aligned in the Y direction, while the outside contacting portions 13B of the first contacts 13 are exposed on the surface of each projection 23 and aligned in the Y direction.

Figure 10:
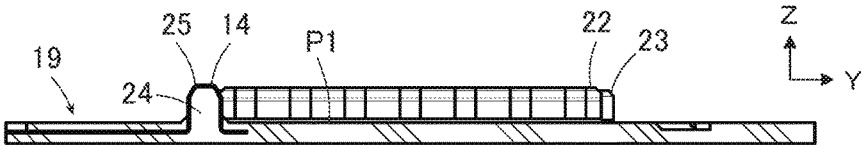
FIG. 10 is a cross-sectional view taken along line B-B in FIG. 8.
Figure 11:
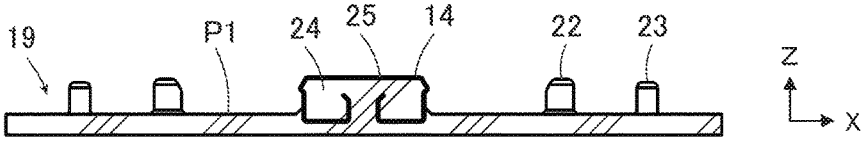
FIG. 11 is a cross-sectional view taken along line C-C in FIG. 8.

The first insulating member 19 has one convex portion 24 that projects from the first fitting surface P1 in the +Z direction between the −Y directional ends of the two convex portions 22 and extends in the X direction. As shown in FIGS. 10 and 11, a metal member 25 is disposed to be exposed on a surface of the convex portion 24 and embedded in the first insulating member 19 in regions other than the convex portion 24. The convex portion 24 and a part of the metal member 25 that is exposed on the surface of the convex portion 24 together form the locking portion 14.

Figure 12:
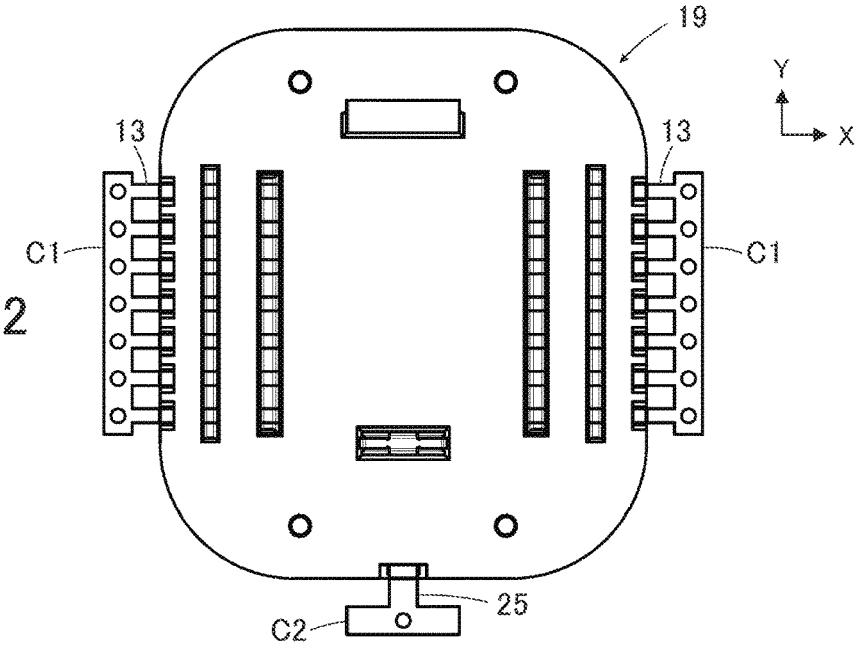
FIG. 12 is a plan view showing the first insulating member in a manufacturing process.

The first insulating member 19 configured as above can be formed through insert molding using the first contacts 13 joined to a carrier C1 and the metal member 25 joined to a carrier C2 as shown in FIG. 12. The first insulating member 19 shown in FIG. 8 can be obtained by cutting off the carriers C1 and C2 after insert molding.

Now, a method of producing the garment-side connector portion 11 is described.

Figure 13:
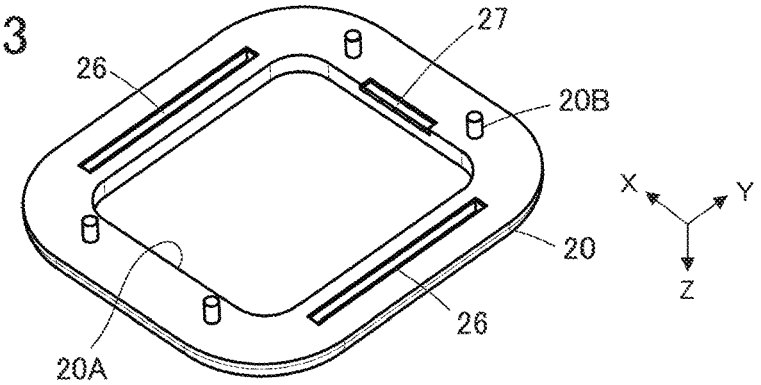
FIG. 13 is a perspective view of a second insulating member of the garment-side connector body in the garment-side connector portion as viewed from obliquely below.

First, as shown in FIG. 13, the second insulating member 20 is placed on, for instance, a workbench (not shown) such that the −Z direction-side surface of the second insulating member 20, on which the four bosses 20B project, faces upward. The −Z direction-side surface of the frame-shaped second insulating member 20 is provided with two projection accommodating portions 26 of recess shape that extend in the Y direction. These projection accommodating portions 26 are provided to accommodate the projections 23 of the first insulating member 19.

The −Z direction-side surface of the second insulating member 20 is also provided at the +Y direction-side edge of the opening 20A with a first abutment surface 27 facing in the −Z direction. When the first insulating member 19 and the second insulating member 20 are joined together, the first abutment surface 27 is positioned directly above, i.e., on the +Z direction side of, the recess portion 18 of the first insulating member 19 so as to face in the −Z direction opposite to the +Z direction in which the first fitting surface P1 faces.

Figure 14:
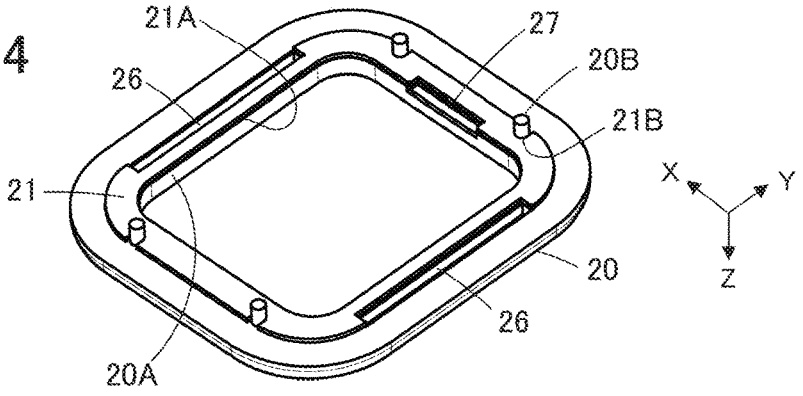
FIG. 14 is a perspective view of a second waterproof member disposed on the second insulating member as viewed from obliquely below.

Next, as shown in FIG. 14, the sheet-type waterproof member 21 is disposed on the −Z direction-side surface of the second insulating member 20. At this time, the bosses 20B of the second insulating member 20 are inserted into the cutouts 21B of the sheet-type waterproof member 21, and the opening 21A of the sheet-type waterproof member 21 is aligned with the opening 20A of the second insulating member 20. The projection accommodating portions 26 and the first abutment surface 27 of the second insulating member 20 are exposed in the −Z direction without being covered with the sheet-type waterproof member 21.

Figure 15:
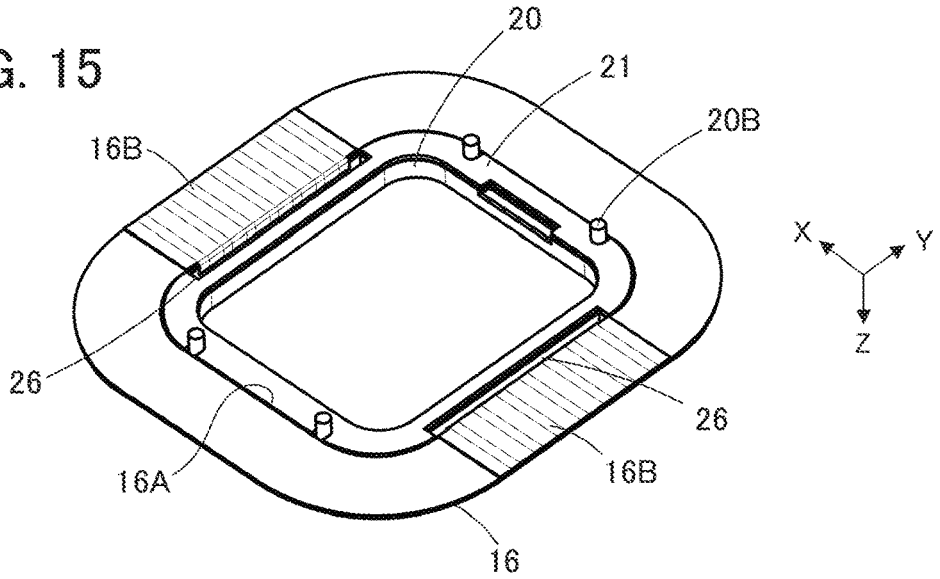
FIG. 15 is a perspective view of the second waterproof member and a conductive sheet that are disposed on the second insulating member as viewed from obliquely below.

Further, as shown in FIG. 15, the conductive sheet 16 is disposed on the −Z direction-side surface of the second insulating member 20. At this time, the four bosses 20B of the second insulating member 20 and the sheet-type waterproof member 21 are accommodated within the opening 16A of the conductive sheet 16. The one ends of the conductive members 16B that project inside the opening 16A of the conductive sheet 16 are bent in the +Z direction and inserted in the projection accommodating portions 26 of the second insulating member 20.

Figure 16:
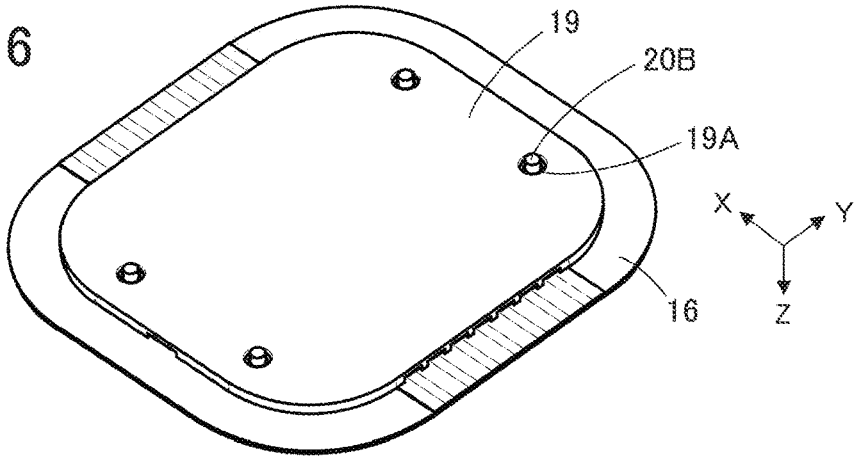
FIG. 16 is a perspective view of the first insulating member disposed on the second insulating member as viewed from obliquely below.

In this state, as shown in FIG. 16, the first insulating member 19 is disposed on the sheet-type waterproof member 21 and the conductive sheet 16 and pushed in the Z direction. Since the sheet-type waterproof member 21 is slightly larger in thickness than the conductive sheet 16, when the first insulating member 19 is pushed in the +Z direction, the sheet-type waterproof member 21 is compressed and deformed in the Z direction by the first insulating member 19. By inserting the four bosses 20B of the second insulating member 20 into the four insertion holes 19A of the first insulating member 19, the first insulating member 19 is positioned with respect to the second insulating member 20, the sheet-type waterproof member 21 and the conductive sheet 16, and the two projections 23 of the first insulating member 19 are inserted into the two projection accommodating portions 26 of the second insulating member 20.

Figure 17:
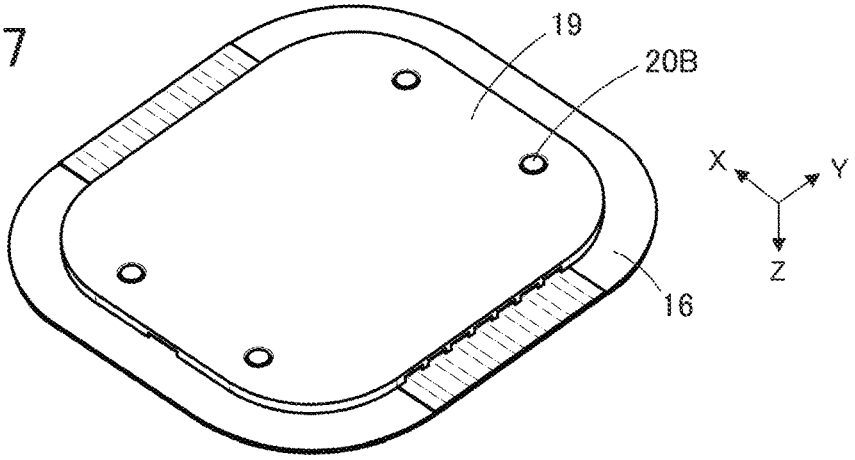
FIG. 17 is a perspective view of the first insulating member attached to the second insulating member as viewed from obliquely below.

Thereafter, as shown in FIG. 17, the heads of the bosses 20B of the second insulating member 20 that project in the −Z direction from the insertion holes 19A of the first insulating member 19 are deformed by heat or the like and pressed. Thus, the production of the garment-side connector portion 11 shown in FIGS. 4 and 5 is finished.

Figure 18:
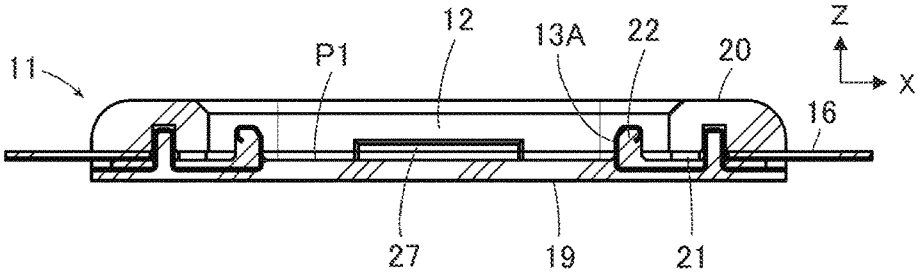
FIG. 18 is a cross-sectional view taken along line D-D in FIG. 5.

A cross-sectional view taken along line D-D in FIG. 5 is shown in FIG. 18. The sheet-type waterproof member 21 and the conductive sheet 16 are sandwiched between the first insulating member 19 and the second insulating member 20, and the sheet-type waterproof member 21 is compressed and deformed in the Z direction; therefore, water is prevented from entering the first fitting surface P1 through a gap between the first insulating member 19 and the second insulating member 20.

The first insulating member 19 and the second insulating member 20 form the module-side connector accommodating portion 12 of recess shape, and the second contact contacting portions 13A of the first contacts 13 are positioned on the first fitting surface P1, which is the bottom surface of the module-side connector accommodating portion 12, and exposed on the surfaces of the convex portions 22.

Figure 19:
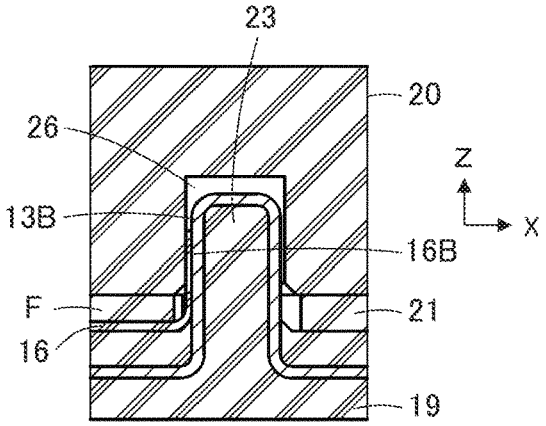
FIG. 19 is an enlarged view of an important part of FIG. 18.

As shown in FIG. 19, each conductive member 16B of the conductive sheet 16 attached to a garment F is inserted in the projection accommodating portion 26 of the second insulating member 20, sandwiched between the inner surface of the projection accommodating portion 26 and the outside contacting portion 13B of the first contact 13 disposed on the surface of the projection 23 of the first insulating member 19, and is thus in contact with the outside contacting portion 13B. With this configuration, the first contacts 13 are electrically connected to the conductive members 16B of the conductive sheet 16.

Figure 20:
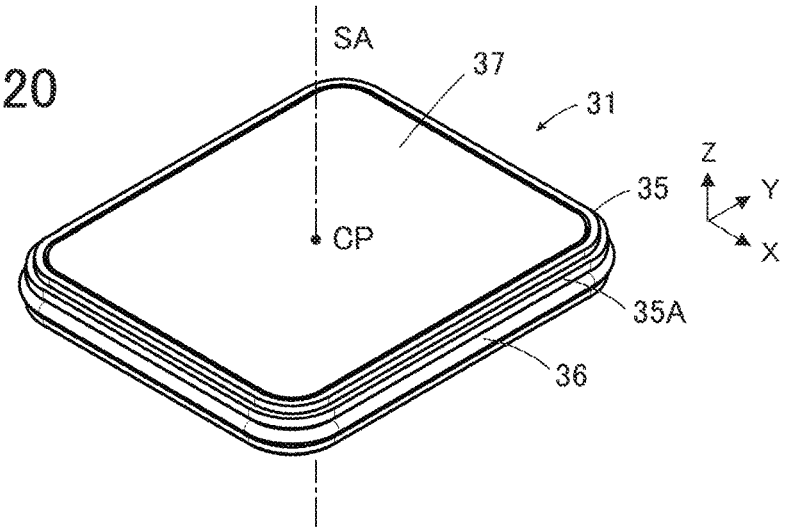
FIG. 20 is a perspective view of the module-side connector portion in the connector of the Embodiment as viewed from obliquely above.

The module-side connector portion 31 is shown in FIG. 20. The module-side connector portion 31 has a module-side connector body 35 in a flat plate shape. The module-side connector body 35 has a lateral surface 35A surrounding the circumference of the module-side connector body 35 in an XY plane, and a ring-shaped waterproof member (first waterproof member) 36 is disposed on the lateral surface 35A. The lateral surface 35A of the module-side connector body 35 extends along a rounded rectangle and has rotational symmetry with respect to a symmetry axis SA passing the center CP of the rectangle and extending vertically to the second fitting surface P2.

The ring-shaped waterproof member 36 is made of an elastically deformable material such as rubber. A substrate 37 is fitted to the module-side connector body 35 from the +Z direction side.

Figure 21:
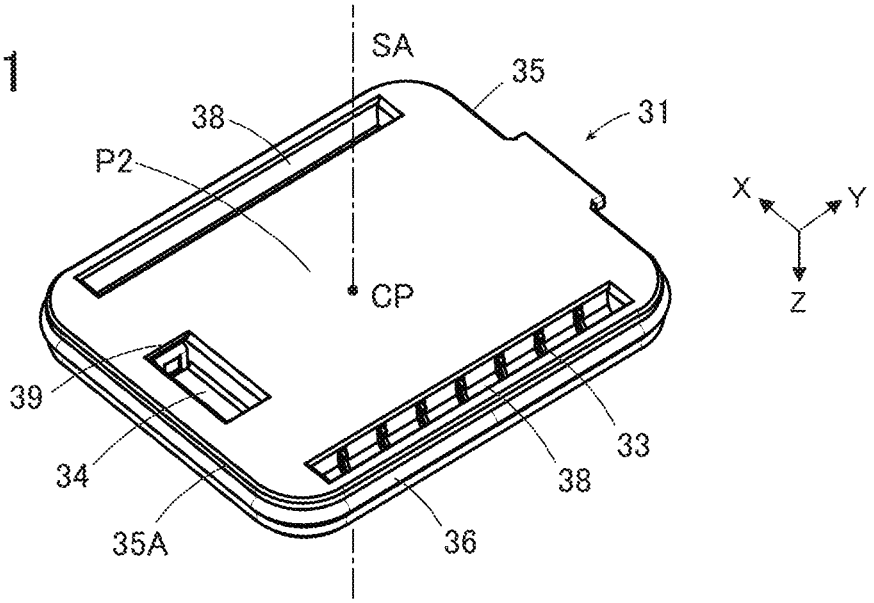
FIG. 21 is a perspective view of the module-side connector portion in the connector of the Embodiment as viewed from obliquely below.

As shown in FIG. 21, the second fitting surface P2 is formed from the −Z direction-side surface of the module-side connector body 35. Two recess portions 38 opening at the second fitting surface P2 and extending in the Y direction are formed separately near the +X and −X directional ends of the second fitting surface P2. These recess portions 38 are provided to receive the convex portions 22 of the first insulating member 19 of the garment-side connector portion 11 when the garment-side connector portion 11 and the module-side connector portion 31 are fitted together. In each recess portion 38, the second contacts 33 are aligned in the Y direction.

The module-side connector body 35 has formed therein a recess portion 39 in the vicinity of the −Y directional end of the second fitting surface P2, and the portion to be locked 34 is disposed in the recess portion 39.

As described above, the lateral surface 35A of the module-side connector body 35 that extends along a rounded rectangle has rotational symmetry with respect to the symmetry axis SA; however, the portion to be locked 34 is disposed away from the symmetry axis SA in the −Y direction, and hence, the outer shape of the module-side connector body 35 including the portion to be locked 34 does not have rotational symmetry with respect to the symmetry axis SA.

Figure 22:
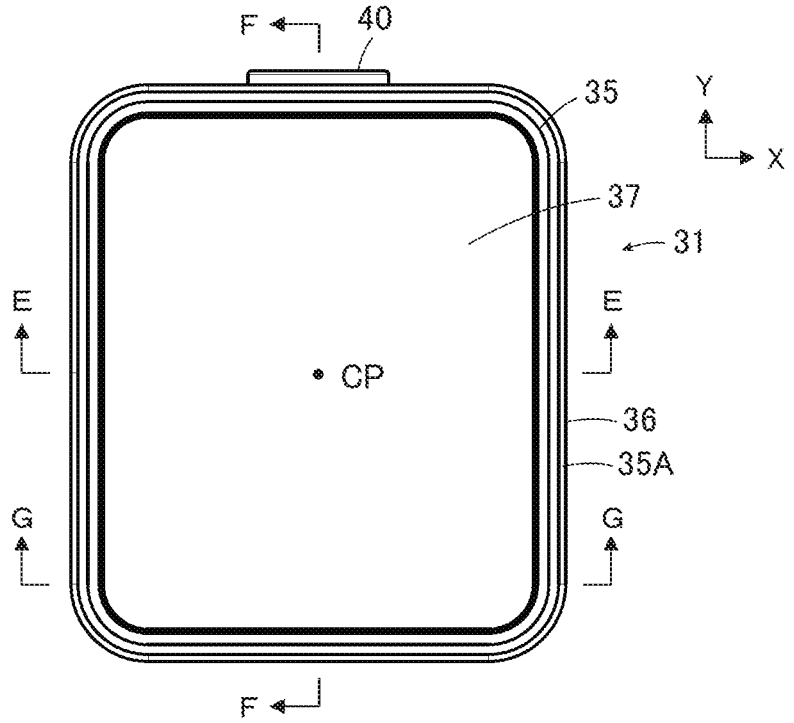
FIG. 22 is a plan view showing the module-side connector portion in the connector of the Embodiment.
Figure 23:
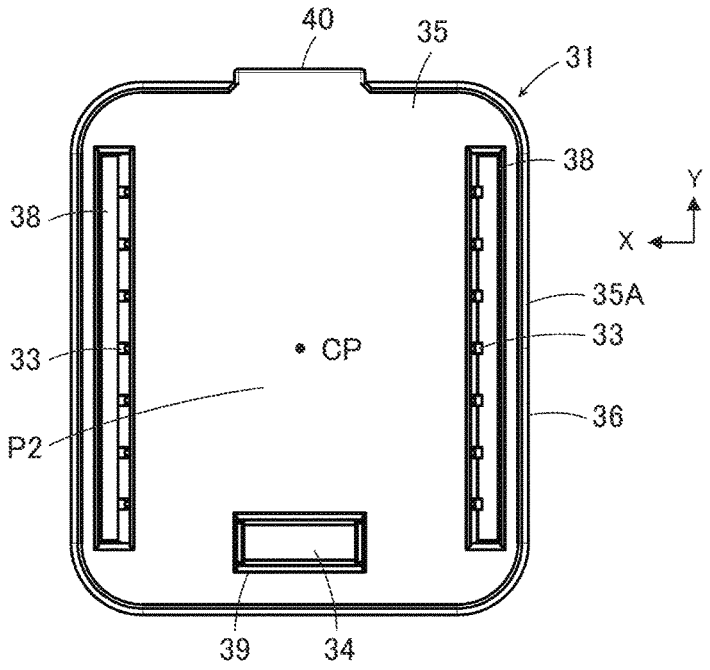
FIG. 23 is a bottom view showing the module-side connector portion in the connector of the Embodiment.

As shown in FIGS. 22 and 23, a protruding portion 40 protruding in the +Y direction is formed at the +Y directional end of the module-side connector body 35.

Figure 24:
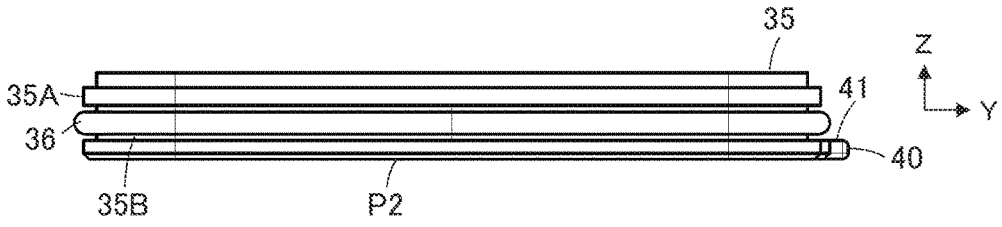
FIG. 24 is a side view showing the module-side connector portion in the connector of the Embodiment.

Since the protruding portion 40 is formed, as shown in FIG. 24, a second abutment surface 41 facing in the +Z direction is provided at the +Y directional end of the module-side connector body 35. The second abutment surface 41 is positioned farther on the −Z direction side, i.e., closer to the second fitting surface P2 than the ring-shaped waterproof member 36 is.

A groove 35B surrounding the circumference of the module-side connector body 35 is formed along the lateral surface 35A of the module-side connector body 35, and the ring-shaped waterproof member 36 is disposed in the groove 35B such that a surface of the ring-shaped waterproof member 36 overhangs more outward than the lateral surface 35A of the module-side connector body 35 in an XY plane.

Figure 25:
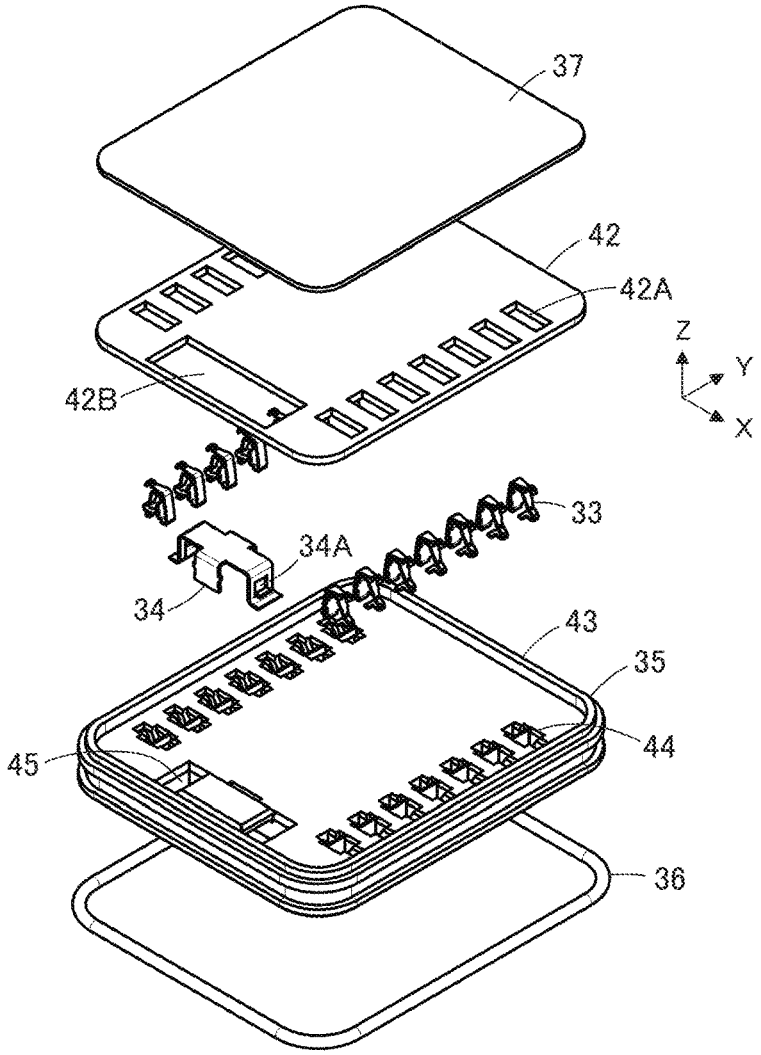
FIG. 25 is an exploded perspective view of the module-side connector portion in the connector of the Embodiment.

FIG. 25 shows an exploded perspective view of the module-side connector portion 31. The module-side connector portion 31 has the structure in which the second contacts 33, the portion to be locked 34 and the ring-shaped waterproof member 36 are mounted in the module-side connector body 35 and the substrate 37 is attached to the +Z direction side of the module-side connector body 35 via a sheet-type waterproof member 42.

A peripheral wall 43 protruding in the +Z direction is formed at the peripheral edge of the +Z direction-side surface of the module-side connector body 35. A plurality of second contact mounting portions 44 of recess shape are aligned in the Y direction separately near the +X and −X directional ends of the +Z direction-side surface of the module-side connector body 35 within the region surrounded by the peripheral wall 43. These second contact mounting portions 44 communicate with the recess portions 38 that open at the second fitting surface P2 of the module-side connector body 35. A mounting portion for portion to be locked 45 of recess shape is formed near the −Y directional end of the +Z direction-side surface of the module-side connector body 35. The mounting portion for portion to be locked 45 communicates with the recess portion 39 that opens at the second fitting surface P2 of the module-side connector body 35.

The portion to be locked 34 is formed from a metal member that is bent into a substantially box-like shape recessed in the +Z direction and is provided at each of its opposite ends in the X direction with a hook receiving portion 34A opening in the X direction.

The sheet-type waterproof member 42 is made of an elastically deformable material such as rubber and has a plurality of openings 42A corresponding to the second contact mounting portions 44 of the module-side connector body 35 and one opening 42B corresponding to the mounting portion for portion to be locked 45.

A method of producing the module-side connector portion 31 is described.

Figure 26:
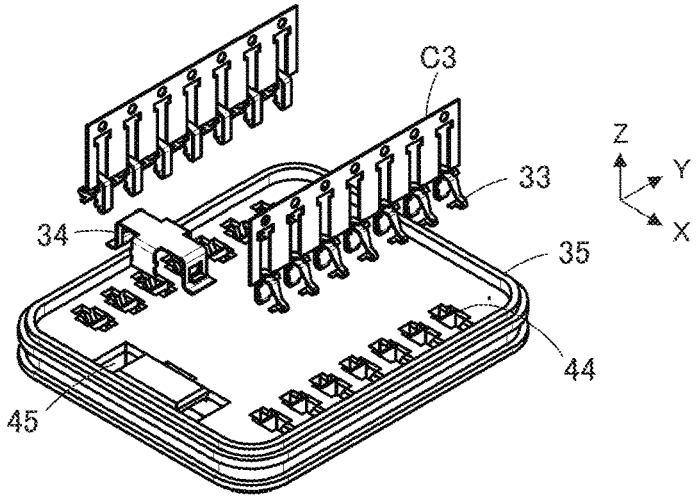
FIG. 26 is a perspective view showing a plurality of second contacts and a portion to be locked that are positioned with respect to a module-side connector body of the module-side connector portion.

First, as shown in FIG. 26, the second contacts 33 joined to a carrier C3 are positioned above (on the +Z direction side of) the second contact mounting portions 44 of the module-side connector body 35, while the portion to be locked 34 formed from the metal member is positioned above (on the +Z direction side of) the mounting portion for portion to be locked 45 of the module-side connector body 35.

Figure 27:
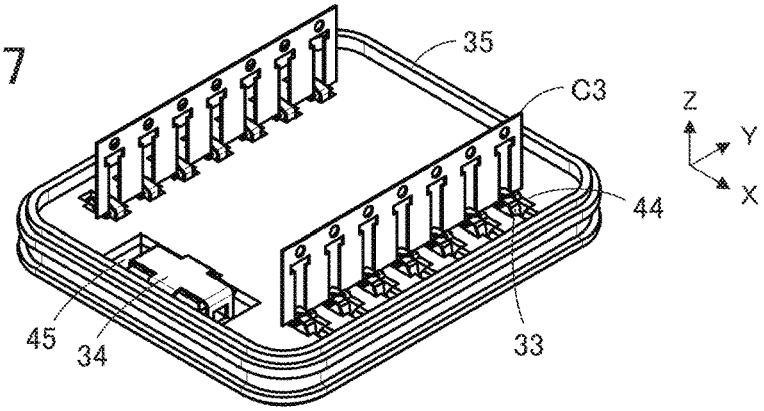
FIG. 27 is a perspective view showing the second contacts and the portion to be locked that are press-fitted in the module-side connector body of the module-side connector portion.

Then, the second contacts 33 joined to the carrier C3 and the portion to be locked 34 are moved in the −Z direction toward the module-side connector body 35, so that the second contacts 33 are press-fitted and mounted in the second contact mounting portions 44 while the portion to be locked 34 is press-fitted and installed in the mounting portion for portion to be locked 45 as shown in FIG. 27.

Figure 28:
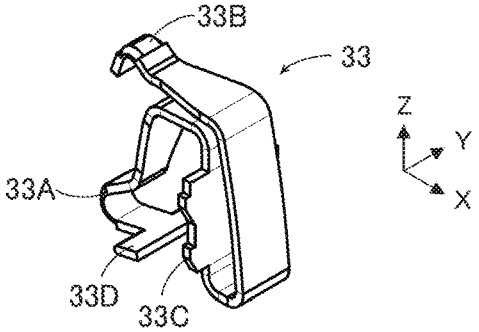
FIG. 28 is a perspective view of a second contact as viewed from obliquely above.
Figure 29:
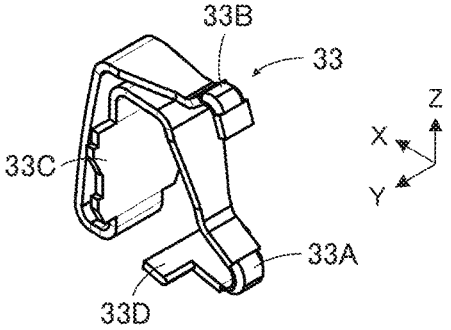
FIG. 29 is a perspective view of the second contact as viewed from another position.

As shown in FIGS. 28 and 29, the second contact 33 is a contact formed from a bent metal sheet and having spring properties and includes a first contact contacting portion 33A positioned near its one end and facing in the X direction, a substrate contacting portion 33B positioned at its other end and facing in the +Z direction, and a fixing portion 33C positioned between the first contact contacting portion 33A and the substrate contacting portion 33B. The second contact 33 further includes an overhanging portion 33D positioned near the first contact contacting portion 33A and overhanging in the Y direction.

Figure 30:
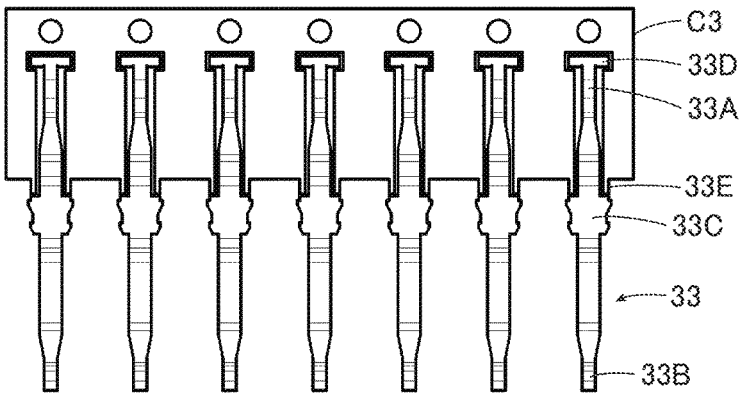
FIG. 30 is a development view of the second contacts connected to a carrier.
Figure 31:
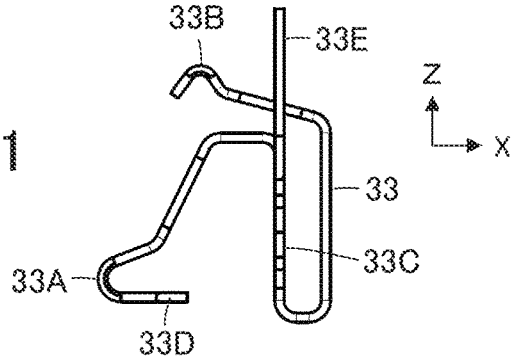
FIG. 31 is a side view showing the second contact.

By bending the second contacts 33 joined to the carrier C3 via associated joint bars 33E connected to the associated fixing portions 33C as shown in FIG. 30, the second contacts 33 are produced as shown in FIG. 31.

Figure 32:
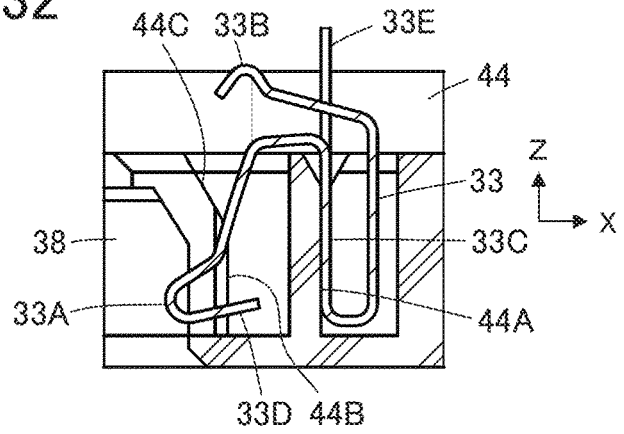
FIG. 32 is a cross-sectional view showing the second contact press-fitted in the module-side connector body.
Figure 33:
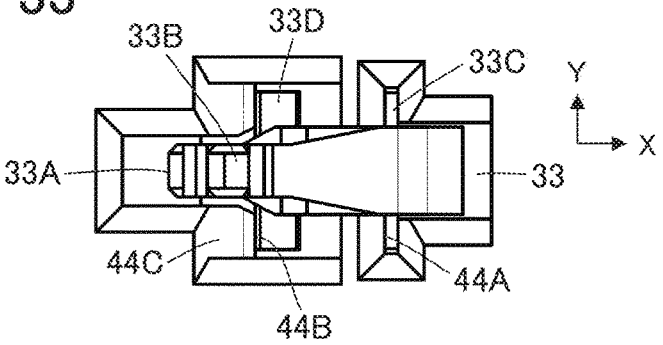
FIG. 33 is a plan view showing the second contact press-fitted in the module-side connector body.

The second contact 33 mounted in the second contact mounting portion 44 of the module-side connector body 35 is shown in FIGS. 32 and 33. The second contact mounting portion 44 has a second contact press-fit portion 44A which is formed along a YZ plane and into which the fixing portion 33C of the second contact 33 is press-fitted, a preload surface 44B which is formed along a YZ plane and contacts with the overhanging portion 33D of the second contact 33 to apply a preload to the first contact contacting portion 33A of the second contact 33, and an inclined surface 44C connected to the +Z directional end of the preload surface 44B.

When the second contact 33 joined to the carrier C3 is moved from the +Z direction toward the −Z direction and inserted into the second contact mounting portion 44, the fixing portion 33C of the second contact 33 is being press-fitted into the second contact press-fit portion 44A of the second contact mounting portion 44 while the overhanging portion 33D of the second contact 33 comes into contact with the inclined surface 44C of the second contact mounting portion 44. In this state, when the second contact 33 is further moved toward the −Z direction, the overhanging portion 33D of the second contact 33 is guided by the inclined surface 44C of the second contact mounting portion 44 and consequently displaced to gradually approach the fixing portion 33C. Then, the overhanging portion 33D of the second contact 33 reaches the preload surface 44B of the second contact mounting portion 44, and thus, as shown in FIG. 32, the second contact 33 is completely mounted in the second contact mounting portion 44.

The overhanging portion 33D of the second contact 33 is in contact with the preload surface 44B of the second contact mounting portion 44, whereby a preload acting in the X direction is applied to the first contact contacting portion 33A of the second contact 33. At this time, although the first contact contacting portion 33A of the second contact 33 projects inside the recess portion 38 of the module-side connector body 35 that communicates with the second contact mounting portion 44, since a preload is applied to the first contact contacting portion 33A, the projection amount of the first contact contacting portion 33A inside the recess portion 38 is controlled to a predetermined extent. This configuration makes it possible to prevent a user's finger or the like from mistakenly contacting with any of the first contact contacting portions 33A of the second contacts 33 through the associated recess portion 38 opening at the second fitting surface P2 of the module-side connector body 35 when, for instance, the module-side connector portion 31 is attached to or detached from the garment-side connector portion 11.

The second contacts 33 are directly press-fitted into the second contact mounting portions 44 of the module-side connector body 35 for mounting and therefore effectively prevented from being misaligned with respect to the module-side connector body 35. In addition, since the second contact mounting portions 44 each have the inclined surface 44C connected to the preload surface 44B, only by inserting the second contacts 33 into the second contact mounting portions 44 from the +Z direction, preloads can be applied to the first contact contacting portions 33A of the second contacts 33.

When the second contacts 33 are thus completely mounted in the second contact mounting portions 44 of the module-side connector body 35, the joint bars 33E are separated from the second contacts 33 to remove the carrier C3.

Figure 34:
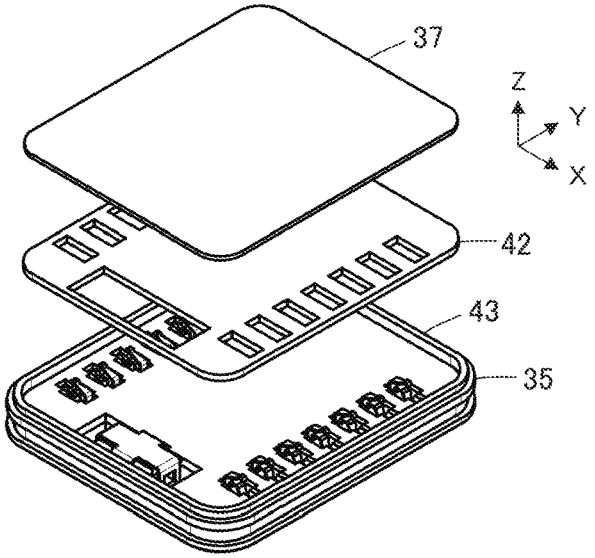
FIG. 34 is a perspective view showing the module-side connector body in which the second contacts and the portion to be locked are press-fitted, a sheet-type waterproof member and a substrate.

Thereafter, as shown in FIG. 34, the substrate 37 is attached to the module-side connector body 35 in the region surrounded by the peripheral wall 43 via the sheet-type waterproof member 42, and then the ring-shaped waterproof member 36 is mounted on the lateral surface 35A of the module-side connector body 35. Thus, the production process of the module-side connector portion 31 shown in FIGS. 20 to 23 is completed.

Figure 35:
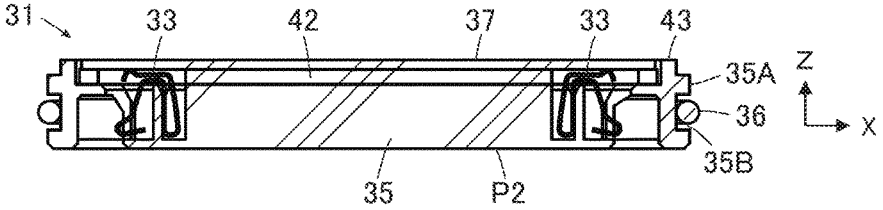
FIG. 35 is a cross-sectional view taken along line E-E in FIG. 22.

A cross-sectional view taken along line E-E in FIG. 22 is shown in FIG. 35. The ring-shaped waterproof member 36 is disposed in the groove 35B in the lateral surface 35A of the module-side connector body 35.

The sheet-type waterproof member 42 and the substrate 37 are disposed in the region surrounded by the peripheral wall 43 of the module-side connector body 35, and the openings 42A in the sheet-type waterproof member 42 are situated above, i.e., on the +Z direction side of, the second contacts 33 correspondingly.

Figure 36:
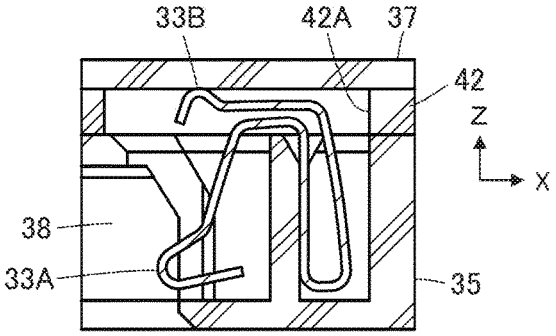
FIG. 36 is an enlarged view of an important part of FIG. 35.

Therefore, when the substrate 37 is moved from the +Z direction toward the −Z direction and disposed in the region surrounded by the peripheral wall 43 of the module-side connector body 35, as shown in FIG. 36, the substrate contacting portion 33B of each second contact 33 is contacted with the −Z direction-side surface of the substrate 37 through the opening 42A in the sheet-type waterproof member 42 and is then pressed in the −Z direction to be elastically displaced. As a result, the substrate contacting portion 33B of each second contact 33 is electrically connected to a connection pad (not shown) formed on the −Z direction-side surface of the substrate 37.

Since the substrate contacting portions 33B of the second contacts 33 are thus elastically displaced to be contacted with the substrate 37, the second contacts 33 can be electrically connected to the substrate 37 only by mechanically assembling the module-side connector portion 31 without any mounting process such as soldering.

Since the substrate contacting portions 33B of the second contacts 33 are situated right above, i.e., on the +Z direction side of, the first contact contacting portions 33A, the second contacts 33 can be each disposed in a small space, in particular, this structure makes it possible to minimize the width of the module-side connector portion 31 in the X direction to a small width.

Figure 37:
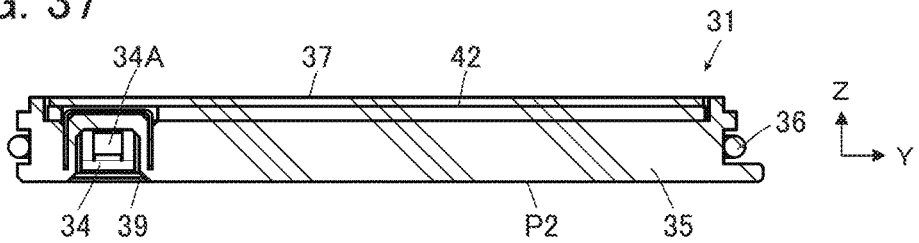
FIG. 37 is a cross-sectional view taken along line F-F in FIG. 22.
Figure 38:
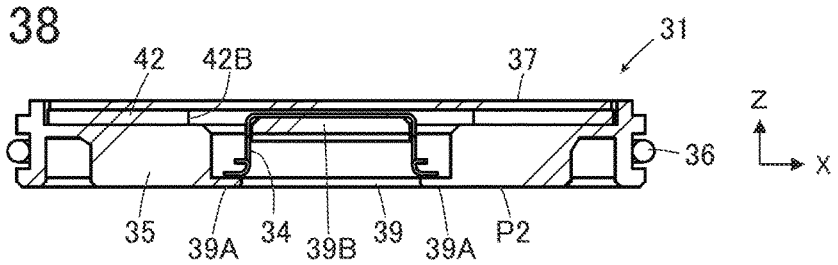
FIG. 38 is a cross-sectional view taken along line G-G in FIG. 22.

Cross-sectional views taken along lines F-F and G-G in FIG. 22 are shown in FIGS. 37 and 38, respectively. The portion to be locked 34 is disposed in the recess portion 39 opening at the second fitting surface P2 of the module-side connector body 35. The portion to be locked 34 has a recess shape that is recessed in the +Z direction from the second fitting surface P2.

As shown in FIG. 38, support portions for portion to be locked 39A and 39B formed from part of the module-side connector body 35 are provided in the recess portion 39 of the module-side connector body 35, and the portion to be locked 34 is disposed so as to be in contact with the support portions for portion to be locked 39A and 39B on the +Z direction side thereof.

Figure 39:
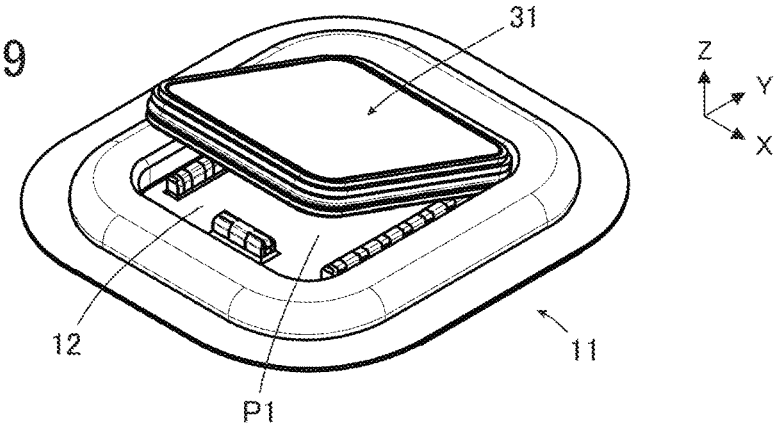
FIG. 39 is a perspective view showing the state where the module-side connector portion is being fitted to the garment-side connector portion.
Figure 40:
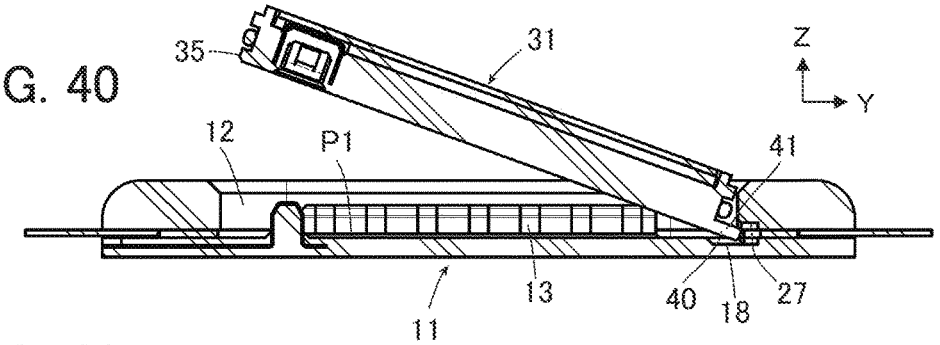
FIG. 40 is a cross-sectional view showing the state where the module-side connector portion is being fitted to the garment-side connector portion.

In a process for fitting the module-side connector portion 31 to the garment-side connector portion 11, firstly, as shown in FIG. 39, the module-side connector portion 31 is placed to be inclined to the garment-side connector portion 11, and the +Y directional end of the module-side connector portion 31 is inserted into the +Y directional end of the module-side connector accommodating portion 12 of the garment-side connector portion 11. At this time, as shown in FIG. 40, the protruding portion 40 protruding from the +Y directional end of the module-side connector portion 31 is inserted in the recess portion 18 of the module-side connector accommodating portion 12 of the garment-side connector portion 11 so as to catch on the first abutment surface 27 of the garment-side connector portion 11 situated right above the recess portion 18. That is, the second abutment surface 41 formed at the protruding portion 40 abuts on the first abutment surface 27 of the garment-side connector portion 11 in the Z direction.

Figure 41:
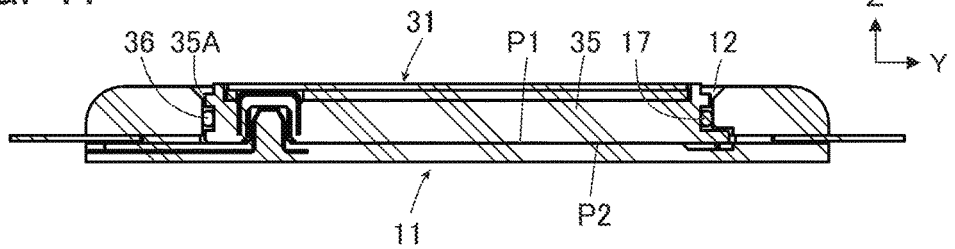
FIG. 41 is a cross-sectional view taken along line H-H in FIG. 2.

In this state, when the −Y directional end of the module-side connector portion 31 is pushed toward the first fitting surface P1 of the module-side connector accommodating portion 12 of the garment-side connector portion 11, the module-side connector portion 31 is, along a YZ plane, rotated about the protruding portion 40 catching on the first abutment surface 27 of the garment-side connector portion 11, and as shown in FIG. 41, the module-side connector body 35 of the module-side connector portion 31 is accommodated in the module-side connector accommodating portion 12 of the garment-side connector portion 11. Thus, the module-side connector portion 31 is fitted to the garment-side connector portion 11 such that the first fitting surface P1 of the garment-side connector portion 11 and the second fitting surface P2 of the module-side connector portion 31 contact with each other or, in other words, face each other in parallel.

Figure 42:
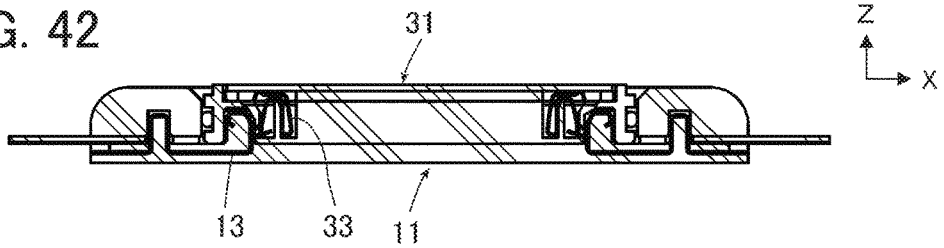
FIG. 42 is a cross-sectional view taken along line J-J in FIG. 2.

When the module-side connector portion 31 is fitted to the garment-side connector portion 11, as shown in FIG. 42, the first contacts 13 of the garment-side connector portion 11 and the second contacts 33 of the module-side connector portion 31 contact with each other to be electrically connected to each other.

Figure 43:
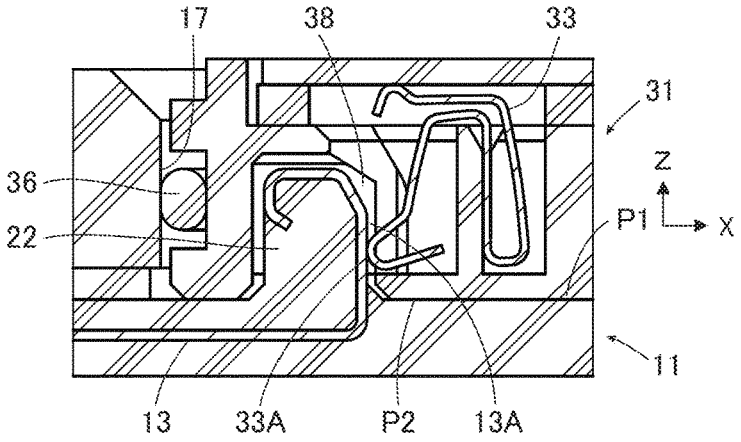
FIG. 43 is an enlarged view of an important part of FIG. 42.

At this time, as shown in FIG. 43, the convex portion 22 projecting from the first fitting surface P1 of the garment-side connector portion 11 in the +Z direction is inserted into the recess portion 38 opening at the second fitting surface P2 of the module-side connector portion 31, and the first contact contacting portion 33A of the second contact 33 projecting inside the recess portion 38 is pressed by the second contact contacting portion 13A of the first contact 13 disposed on the surface of the convex portion 22 and is thereby elastically displaced. Thus, the first contact contacting portion 33A contacts with the second contact contacting portion 13A at a predetermined contact pressure.

Figure 44:
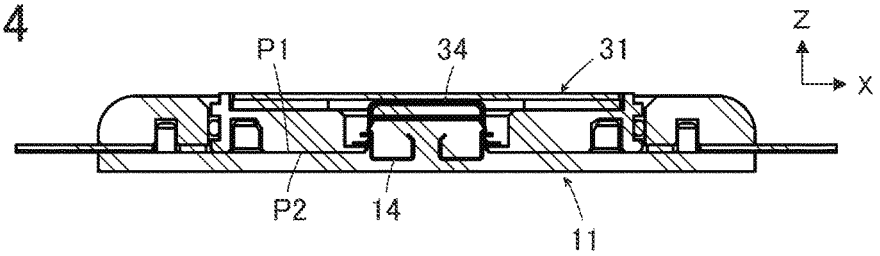
FIG. 44 is a cross-sectional view taken along line K-K in FIG. 2.

When the module-side connector body 35 of the module-side connector portion 31 is accommodated in the module-side connector accommodating portion 12 of the garment-side connector portion 11, as shown in FIG. 44, the locking portion 14 of convex shape that projects from the first fitting surface P1 of the garment-side connector portion 11 in the +Z direction is fitted in the portion to be locked 34 of recess shape that is recessed from the second fitting surface P2 of the module-side connector portion 31 in the +Z direction.

Figure 45:
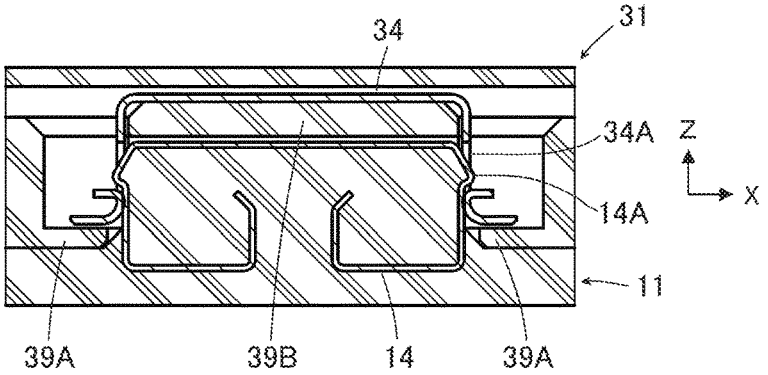
FIG. 45 is an enlarged view of an important part of FIG. 44.
Figure 46:
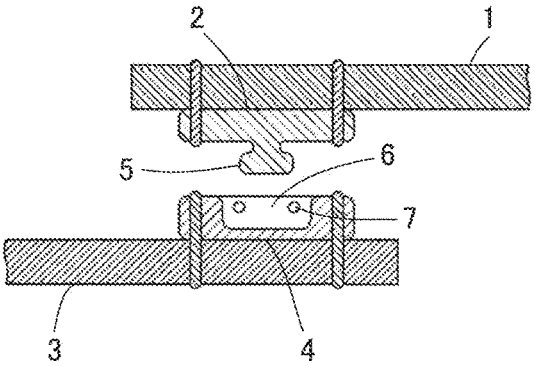
FIG. 46 PRIOR ART
FIG. 46 is a cross-sectional view showing a conventional snap button connector.

At this time, as shown in FIG. 45, hook portions 14A protruding in the X direction separately from the opposite ends, in the X direction, of the locking portion 14 respectively catch on the hook receiving portions 34A formed at the opposite ends, in the X direction, of the portion to be locked 34 and opening in the X direction, whereby the fitting state between the garment-side connector portion 11 and the module-side connector portion 31 is locked. Note that the portion to be locked 34 is disposed so as to be in contact with the +Z direction side of the support portion for portion to be locked 39B of the module-side connector body 35; therefore, when the module-side connector portion 31 in the fitting state is pulled out from the garment-side connector portion 11 in the +Z direction, the portion to be locked 34 is prevented from being caught on the locking portion 14 and thereby deforming.

When the module-side connector portion 31 is thus fitted to the garment-side connector portion 11, the ring-shaped waterproof member 36 of the module-side connector portion 31 is elastically compressed between the lateral surface 35A of the module-side connector body 35 and the lateral wall 17 of the module-side connector accommodating portion 12 of the garment-side connector portion 11, whereby water is prevented from entering the first fitting surface P1 and the second fitting surface P2.

Since the ring-shaped waterproof member 36 is mounted on the lateral surface 35A of the module-side connector body 35 that extends along a rounded rectangle having rotational symmetry with respect to the symmetry axis SA, entering of water can be effectively prevented.

While the lateral surface 35A of the module-side connector body 35 has rotational symmetry with respect to the symmetry axis SA, the outer shape of the module-side connector body 35 including the portion to be locked 34 of recess shape does not have rotational symmetry with respect to the symmetry axis SA. Hence, in FIGS. 39 and 40, even if an attempt is made to accommodate the module-side connector portion 31 in the opposite orientation, i.e., with the protruding portion 40 being placed at the −Y directional end, into the module-side connector accommodating portion 12 of the garment-side connector portion 11, the locking portion 14 of the garment-side connector portion 11 is not aligned with the portion to be locked 34 of the module-side connector portion 31, so that the module-side connector portion 31 cannot be fitted to the garment-side connector portion 11.

Thus, it is possible to, while achieving an excellent waterproof effect, prevent the module-side connector portion 31 from being fitted in the garment-side connector portion 11 in the wrong orientation.

As described above, since the module-side connector portion 31 is, along a YZ plane, rotated about the protruding portion 40 catching on the first abutment surface 27 of the garment-side connector portion 11 and fitted to the garment-side connector portion 11, the second contacts 33 of the module-side connector portion 31 aligned in the Y direction come into contact with the first contacts 13 of the garment-side connector portion 11 aligned in the Y direction not at a time but sequentially one by one, thereby establishing their electrical connections. Hence, compared to the case where the first contacts 13 and the second contacts 33 are brought into connection at a time with the garment-side connector portion 11 and the module-side connector portion 31 being positioned in parallel to each other, the module-side connector portion 31 can be fitted to the garment-side connector portion 11 with less power.

The locking portion 14 and the portion to be locked 34 are not provided at the opposite ends, in the Y direction, of the garment-side connector portion 11 and the module-side connector portion 31 but are provided only near the −Y directional ends of the garment-side connector portion 11 and the module-side connector portion 31, respectively. The first abutment surface 27 of the garment-side connector portion 11 and the second abutment surface 41 of the module-side connector portion 31, however, abut against each other in the Z direction near the +Y directional ends of the garment-side connector portion 11 and the module-side connector portion 31; therefore, only one combination of the locking portion 14 and the portion to be locked 34 is enough to firmly lock the fitting state between the garment-side connector portion 11 and the module-side connector portion 31.

Thus, compared to the case where two combinations of the locking portions 14 and the portions to be locked 34 are provided separately near the opposite ends, in the Y direction, of the garment-side connector portion 11 and the module-side connector portion 31, the lock mechanism can be constructed with a less number of components and lower cost.

While, in the foregoing embodiment, the substrate 37 attached to the module-side connector body 35 in the region surrounded by the peripheral wall 43 is exposed, it is preferable for the module-side connector portion 31 to have a cover member (not shown) covering the substrate 37 on the +Z direction side of the module-side connector body 35. In this case, the cover member may be provided with a handle used to pull out the module-side connector portion 31 being in the fitting state from the garment-side connector portion 11 in the +Z direction.

While, in the foregoing embodiment, the module-side connector body 35 is accommodated and fitted in the recess-shaped module-side connector accommodating portion 12 of the garment-side connector body 15, the opposite configuration may be employed in which a recess-shaped garment-side connector accommodating portion is formed in a module-side connector body and a garment-side connector body is accommodated and fitted in the garment-side connector accommodating portion of the module-side connector body.

While the ring-shaped waterproof member (first waterproof member) 36 is disposed on the lateral surface 35A surrounding the circumference of the module-side connector body 35, the ring-shaped waterproof member (first waterproof member) 36 may be disposed on the lateral wall 17 of the garment-side connector body 15.

The first contacts 13 are aligned on the first fitting surface P1 of the garment-side connector portion 11 in two rows along two straight lines parallel to each other, and the second contacts 33 are aligned on the second fitting surface P2 of the module-side connector portion 31 in two rows along two straight lines parallel to each other; however, the invention is not limited thereto, and the first contacts 13 may be aligned in one or three or more rows, and the same applies to the second contacts 33. In this invention, it suffices if there are provided one or more first contacts 13 disposed on the first fitting surface P1 and one or more second contacts 33 disposed on the second fitting surface P2, and the numbers of the first contacts 13 and the second contacts 33 are not limited to those illustrated in the relevant figures.

While the lateral surface 35A of the module-side connector body 35 extends along a rounded rectangle and has rotational symmetry with respect to the symmetry axis SA, the lateral surface 35A may extend along any rounded polygon other than a rectangle to have rotational symmetry with respect to the symmetry axis SA.

What is claimed is:

1. A connector for mounting a module of a wearable device on a garment to establish electrical connection therebetween, the connector comprising:

a garment-side connector portion to be attached to the garment; and a module-side connector portion to be fitted to the garment-side connector portion, wherein the garment-side connector portion includes a garment-side connector body having a first fitting surface and a lateral wall surrounding the first fitting surface, one or more first contacts disposed on the first fitting surface of the garment-side connector body, and a locking portion disposed on the first fitting surface of the garment-side connector body, wherein the module-side connector portion includes a module-side connector body having a second fitting surface that, when the module-side connector portion is fitted with the garment-side connector portion, faces the first fitting surface and also having a lateral surface surrounding the second fitting surface, one or more second contacts disposed in the second fitting surface of the module-side connector body, and a portion to be locked disposed on the second fitting surface of the module-side connector body, wherein a first waterproof member that is elastically deformable is disposed on one of the lateral wall of the garment-side connector body and the lateral surface of the module-side connector body so as to surround the first fitting surface or the second fitting surface, wherein the locking portion locks a position of the portion to be locked only when the module-side connector body is fitted with the garment-side connector body in a predetermined orientation, and wherein the one or more first contacts and the one or more second contacts are electrically connected to each other, the module-side connector portion is fitted with the garment-side connector portion, and the first waterproof member is elastically compressed between the lateral wall of the garment-side connector body and the lateral surface of the module-side connector body, whereby water is prevented from entering the first fitting surface and the second fitting surface.

2. The connector according to claim 1, wherein the garment-side connector body includes a module-side connector accommodating portion of recess shape whose bottom surface surrounded by the lateral wall forms the first fitting surface, wherein the module-side connector body is accommodated in the module-side connector accommodating portion when the module side connector portion is fitted with the garment-side connector portion, and wherein the locking portion locks the position of the portion to be locked only when the module-side connector body is accommodated in the module-side connector accommodating portion in the predetermined orientation.

3. The connector according to claim 2, wherein the first waterproof member is disposed on the lateral surface of the module-side connector body so as to surround circumference of the module-side connector body.

4. The connector according to claim 1, wherein the garment-side connector body includes:

a first insulating member having a flat plate shape and forming the first fitting surface;

a second insulating member of frame shape attached to the first insulating member and surrounding the first fitting surface; and a second waterproof member disposed between the first insulating member and the second insulating member so as to surround the first fitting surface to prevent water from entering the first fitting surface through a gap between the first insulating member and the second insulating member.

5. The connector according to claim 4, wherein the first insulating member includes a projection projecting toward the second insulating member, wherein the one or more first contacts have one or more outside contacting portions and are fixed in the first insulating member such that the one or more outside contacting portions are disposed on a surface of the projection, wherein the second insulating member includes a projection accommodating portion of recess shape in which the projection is accommodated, and wherein, by fitting the projection of the first insulating member into the projection accommodating portion of the second insulating member with a conductive sheet disposed on the garment being sandwiched between the first insulating member and the second insulating member, one or more conductive members of the conductive sheet come into contact and are electrically connected with the one or more outside contacting portions of the one or more first contacts.

6. The connector according to claim 1, wherein the lateral surface of the module-side connector body extends along a rounded polygon having rotational symmetry with respect to a symmetry axis extending vertically to the second fitting surface, and wherein an outer shape of the module-side connector body including the portion to be locked does not have rotational symmetry with respect to the symmetry axis.

7. The connector according to claim 6, wherein the portion to be locked is disposed away from the symmetry axis, wherein a second abutment surface facing in a direction opposite from a direction in which the second fitting surface faces is formed at one end of the module-side connector body, the one end being opposed to the portion to be locked across the symmetry axis, wherein a first abutment surface facing in a direction opposite from a direction in which the first fitting surface faces and corresponding to the second abutment surface is formed in the garment-side connector body, and wherein the second abutment surface abuts on the first abutment surface when the module-side connector portion is accommodated in the module-side connector accommodating portion of the garment-side connector portion.

8. The connector according to claim 7, wherein the module-side connector portion is fitted to the garment-side connector portion by inserting the one end of the module-side connector body into the module-side connector accommodating portion such that the second fitting surface is inclined to the first fitting surface and the second abutment surface abuts on the first abutment surface, and then pushing the other end of the module-side connector body on an opposite side from the one end toward the first fitting surface.

9. The connector according to claim 7, wherein the second abutment surface is positioned closer to the second fitting surface than the first waterproof member is.

10. The connector according to claim 7, wherein the module-side connector portion includes a plurality of the second contacts aligned in the second fitting surface along a direction from the one end of the module-side connector body toward the other end thereof, and wherein the garment-side connector portion includes a plurality of the first contacts aligned on the first fitting surface so as to correspond to the plurality of the second contacts.

11. The connector according to claim 1, wherein each of the one or more first contacts is a contact having no spring properties, and wherein each of the one or more second contacts is a contact having spring properties.

12. The connector according to claim 11, wherein the module-side connector portion includes a substrate disposed on a side opposite from a side on which the second fitting surface of the module-side connector body is situated, and wherein each of the one or more second contacts includes: a first contact contacting portion positioned at one end thereof to be contacted with a corresponding one of the one or more first contacts; a substrate contacting portion positioned at the other end thereof and contacting with the substrate; and a fixing portion positioned between the first contact contacting portion and the substrate contacting portion and fixed to the module-side connector body.

13. The connector according to claim 12, wherein the module-side connector body includes a recess portion opening at the second fitting surface, and wherein each of the one or more second contacts is attached to the module-side connector body such that the first contact contacting portion projects inside the recess portion while being applied with a preload.

14. The connector according to claim 13, wherein the garment-side connector body includes a convex portion projecting from the first fitting surface, wherein each of the one or more first contacts includes a second contact contacting portion disposed on a surface of the convex portion to be contacted with a corresponding one of the one or more second contacts, and wherein, in a fitting process between the module-side connector portion and the garment-side connector portion, the convex portion of the garment-side connector body is inserted into the recess portion of the module-side connector body, and the first contact contacting portion of each of the one or more second contacts is elastically displaced to be contacted with the second contact contacting portion of the corresponding one of the one or more first contacts.

15. The connector according to claim 1, wherein the locking portion has a convex shape projecting from the first fitting surface, wherein the portion to be locked has a recess shape recessed from the second fitting surface, and wherein the locking portion is fitted to the portion to be locked in a fitting process between the module-side connector portion and the garment-side connector portion.

16. The connector according to claim 15, wherein the locking portion includes a hook portion protruding in a direction parallel to the first fitting surface, wherein the portion to be locked includes a hook receiving portion opening in a direction parallel to the second fitting surface, and wherein, when the locking portion is fitted in the portion to be locked, the hook portion catches on the hook receiving portion.

* * * * *